US010410847B2

(12) United States Patent
Makarov

(10) Patent No.: US 10,410,847 B2
(45) **Date of Patent: *Sep. 10, 2019**

(54) TARGETED MASS ANALYSIS

(71) Applicant: Thermo Fisher Scientific (Bremen) GmbH, Bremen (DE)

(72) Inventor: Alexander Alekseevich Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/796,515

(22) Filed: Oct. 27, 2017

(65) Prior Publication Data

US 2018/0068837 A1 Mar. 8, 2018

Related U.S. Application Data

(63) Continuation of application No. 15/021,108, filed as application No. PCT/EP2014/069320 on Sep. 10, 2014, now Pat. No. 9,812,307.

(30) Foreign Application Priority Data

Sep. 11, 2013 (GB) ..... 1316164.1

(51) Int. Cl.
*H01J 49/40* (2006.01)
*H01J 49/00* (2006.01)
*H01J 49/42* (2006.01)

(52) U.S. Cl.
CPC ..... *H01J 49/005* (2013.01); *H01J 49/009* (2013.01); *H01J 49/0036* (2013.01); (Continued)

(58) Field of Classification Search
CPC .. H01J 49/0036; H01J 49/005; H01J 49/0077; H01J 49/004; H01J 49/40;
(Continued)

(56) References Cited

U.S. PATENT DOCUMENTS 4,507,555 A 3/1985 Chang
5,545,304 A 8/1996 Smith et al.
(Continued)

FOREIGN PATENT DOCUMENTS

GB 2490958 A 11/2012
WO 2006129083 A2 12/2006
(Continued)

OTHER PUBLICATIONS

S. E. Stein, "An Integrated Method for Spectrum Extraction and Compound Identification from Gas Chromatography/Mass Spectrometry Data," J Am Soc Mass Spectrom, 1999 (10), pp. 770-781.

*Primary Examiner* — Wyatt A Stoffa
(74) *Attorney, Agent, or Firm* — David A. Schell

(57) ABSTRACT

A mass spectrometer comprises: an ion source that generates ions having an initial range of mass-to-charge ratios; an auxiliary ion detector, downstream from the ion source that receives a plurality of first ion samples derived from the ions generated by the ion source and determines a respective ion current measurement for each of the plurality of first ion samples; a mass analyzer, downstream from the ion source that receives a second ion sample derived from the ions generated by the ion source and to generate mass spectral data by mass analysis of the second ion sample; and an output stage that establishes an abundance measurement associated with at least some of the ions generated by the ion source based on the ion current measurements determined by the auxiliary ion detector.

29 Claims, 11 Drawing Sheets

(52) U.S. Cl.
CPC ..... *H01J 49/0077* (2013.01); *H01J 49/40* (2013.01); *H01J 49/421* (2013.01); *H01J 49/425* (2013.01)

(58) Field of Classification Search
CPC ..... H01J 49/421; H01J 49/00; H01J 49/009; H01J 49/425
See application file for complete search history.

(56) References Cited

U.S. PATENT DOCUMENTS

| | | | | |
|---|---|---|---|---|
| 6,140,638 | A | 10/2000 | Tanner et al. | |
| 6,627,874 | B1 | 9/2003 | Yefchak | |
| 9,812,307 | B2 * | 11/2017 | Makarov | H01J 49/0036 |
| 2003/0042415 | A1 | 3/2003 | Hager | |
| 2004/0084613 | A1 | 5/2004 | Bateman et al. | |
| 2004/0217272 | A1 * | 11/2004 | Horning | H01J 49/4265 250/282 |
| 2006/0020400 | A1 * | 1/2006 | Okamura | H01J 49/025 702/22 |
| 2006/0145070 | A1 | 7/2006 | Hondo et al. | |
| 2007/0158546 | A1 * | 7/2007 | Lock | H01J 49/005 250/282 |
| 2007/0262253 | A1 | 11/2007 | Guo et al. | |
| 2007/0278395 | A1 | 12/2007 | Gorenstein et al. | |
| 2010/0090102 | A1 | 4/2010 | Rather et al. | |
| 2011/0186732 | A1 | 8/2011 | Yasuno | |
| 2011/0204218 | A1 * | 8/2011 | Hager | H01J 49/0031 250/282 |
| 2012/0228488 | A1 * | 9/2012 | Decker | H01J 49/0036 250/282 |
| 2013/0112865 | A1 * | 5/2013 | Green | H01J 49/4265 250/282 |
| 2015/0221488 | A1 * | 8/2015 | Hyeon | H01J 49/0009 250/282 |
| 2015/0262799 | A1 * | 9/2015 | Fujita | H01J 49/0031 250/288 |
| 2016/0013040 | A1 * | 1/2016 | Verenchikov | H01J 49/4245 250/282 |
| 2016/0049286 | A1 * | 2/2016 | Park | H01J 49/063 250/282 |
| 2016/0148791 | A1 * | 5/2016 | Bloomfield | H01J 49/025 |
| 2016/0189943 | A1 * | 6/2016 | Bloomfield | H01J 49/025 |
| 2016/0225602 | A1 * | 8/2016 | Ristroph | H01J 49/009 |
| 2016/0240363 | A1 * | 8/2016 | Verenchikov | H01J 49/406 |

FOREIGN PATENT DOCUMENTS

| | | | |
|---|---|---|---|
| WO | 2009150410 | A2 | 12/2009 |
| WO | 2011127544 | A1 | 10/2011 |
| WO | 2012100299 | A1 | 8/2012 |

* cited by examiner

| | Formula | Amount |
|---|---|---|
| 1 | Fe | 1.00 |
| 2 | Cr | 1.00 |
| 3 | Ni | 1.00 |
| 4 | CaO | 0.10 |
| 5 | ArO | 1.00 |
| 6 | ArN | 0.50 |
| 7 | Ca | 1.00 |

TARGETED MASS ANALYSIS

CROSS-REFERENCE TO RELATED APPLICATIONS

The present application is a continuation under 35 U.S.C. § 120 and claims the priority benefit of co-pending U.S. patent application Ser. No. 15/021,108, filed Mar. 10, 2016, which is a United States National Stage Application, under 35 U.S.C. 371, of International Application PCT/EP2014/069320 having an international filing date of Sep. 10, 2014. The disclosures of each of the foregoing applications are incorporated herein by reference.

TECHNICAL FIELD OF THE INVENTION

The invention relates to a mass spectrometer and method of mass spectrometry, particularly tandem mass spectrometry.

BACKGROUND TO THE INVENTION

The targeted mass spectral analysis of complex mixtures has conventionally been carried out using a triple quadrupole mass spectrometer. In these instruments, the mass-to-charge ratio range of precursor ions is selected by a first quadrupole mass analyzer. The precursor ions are fragmented in a gas-filled collision cell and then a particular fragment is selected by a second quadrupole mass analyzer. This allows filtering out only precursor and corresponding fragment ions of interest. It thereby provides a robust quantitative method for targeted analysis, where the targets are known but may be present in very low levels compared with other analytes.

Due to their nature of operation, quadrupole analyzers allow only ions in a narrow window of mass-to-charge (m/z) ratios to be transmitted. Though this m/z ratio window is transmitted with an efficiency that is sometimes greater than 50% and detected using a Secondary Electron Multiplier (SEM) with single ion sensitivity, ions of all other m/z are lost on the analyzer rods. This wasteful operation hinders fast quantitation analysis, where multiple target compounds are desirably analysed within a limited time. Quadrupole mass analyzers must jump from one m/z to another, with their effective duty cycles being quite low (0.1% to 10%, depending on the number of targets).

Further difficulties exist in relation to accurate quantitation in elemental analysis of analytes in quadrupole-based Inductively Coupled Plasma Mass Spectrometry (ICP-MS), due to molecular interferences.

Alternatives to triple quadrupole mass spectrometers are known. For example, simultaneous acquisition of all fragments from all precursors can be performed to provide a single high-resolution, high mass-accuracy spectrum. A subsequent search for ions of the targeted m/z ratio can then be performed. Analyzers using orbital trapping technology (for example, the mass analyzer marketed as Orbitrap™ manufactured by Thermo Fisher Scientific), Fourier Transform Ion Cyclotron Resonance (FT-ICR) analyzers and those based on Time-of-Flight (TOF) are considered examples of accurate mass analyzers for this application.

However, such accurate mass analyzers have significant limitations for modern targeted analysis experiments. For example, the detection limits and dynamic range for orthogonal-acceleration TOF analyzers are significantly worse than in triple quadrupole spectrometers, due to low transmission and limitations of the detection electronics.

Meanwhile, orbital trapping-based analyzers (as well as any other analyzer utilising image current detection, such as FT-ICR or electrostatic traps) have: a sensitivity that is limited by image current detection; a dynamic range limited by charge capacity; and a speed or duty cycle limited by the necessity to detect each transient for tens to hundreds of milliseconds. As a compromise, a combination of an accurate mass analyzer with a quadrupole mass filter allows the combined advantages of all-fragment detection with those of reduced dynamic range resulting from narrow m/z isolation.

For both high-resolution approaches, the desire to minimize the Coefficient of Variation (CV) of mass peak intensity limits the number of measurement points across narrow (0.5-2 sec wide) peaks possible in modern Gas Chromatography (GC) or Ultra-High Performance Liquid Chromatography (UHPLC). Examples of existing such systems are discussed in "New Trends in Fast Liquid Chromatography for Food an Environmental Analysis", Núñez et al (Journal of Chromatography A, 1228 (2012) p. 298-323). Overcoming these difficulties remains a challenge in this area.

SUMMARY OF THE INVENTION

Against this background, the present invention provides, in a first aspect, a mass spectrometer, comprising: an ion source, arranged to generate ions having an initial range of mass-to-charge ratios; an auxiliary ion detector, located downstream from the ion source and arranged to receive a plurality (sequence) of first ion samples derived from the ions generated by the ion source and to determine a respective ion current measurement for each of the first plurality of ion samples; a mass analyzer, located downstream from the ion source and arranged to receive a second ion sample derived from the ions generated by the ion source and to generate mass spectral data by mass analysis of the second ion sample; and an output stage, configured to establish an abundance measurement associated with at least some of the ions generated by the ion source based on the ion current measurements determined by the auxiliary ion detector.

In a second aspect, there may be provided a mass spectrometer, comprising: an ion source, arranged to generate ions having an initial range of mass-to-charge ratios; an auxiliary ion detector, located downstream from the ion source and arranged to receive a first ion sample derived from the ions generated by the ion source and to determine an ion current for the first ion sample; a mass analyzer, located downstream from the ion source and arranged to receive a second ion sample derived from the ions generated by the ion source and to generate mass spectral data by mass analysis of the second ion sample; and an output stage, configured to establish an abundance measurement associated with at least some of the ions generated by the ion source based on the ion current determined by the auxiliary ion detector. Although the various additional features described below are noted with reference to the first aspect, they may be equally applicable to the second aspect.

According to either aspect, the mass spectral data may be used to affect the established abundance measurement, for example, as the abundance measurement may be established based on a combination of the mass spectral data generated by the mass analyzer and the ion current measurements determined by the auxiliary ion detector. Additionally or alternatively, the mass spectral data may be used to control the addition of reaction gas to a reaction cell upstream of the auxiliary detector to remove molecular interferences from the ion current measurement.

The approach may be based on a realisation that the relatively slow targeted analysis using a relatively high resolution analyzer can be complemented and enhanced by detecting analyte ions using an independent auxiliary detector, such as an electron multiplier located downstream from the ion source (and optionally, a mass filter). The auxiliary ion detector is optionally upstream from the mass analyzer. Preferably, the auxiliary detector detects the mass-filtered ion beam.

Data from the low mass-resolution (high temporal resolution) auxiliary detector can then be used for improving the high mass-resolution data, in particular by deconvolution or best-fitting. The high mass-resolution data from the mass analyzer is typically provided with low temporal resolution. Thus, the interpolation, deconvolution or best-fitting approaches are especially made possible by the use of multiple ion current measurements for each mass analysis scan. Advantageously, the auxiliary ion detector has a higher absolute sensitivity than the mass analyzer.

The auxiliary ion detector may be configured to provide the plurality of ion currents over a time period (optionally, a predetermined time period). The mass analyzer is advantageously arranged to generate a single set of mass spectral data over the same time period. Then, the output stage may be configured to establish the abundance measurement based on a combination of the mass spectral data generated in the time period and the plurality of ion currents determined in the time period. Thus, the auxiliary ion detector may provide multiple measurements within the same temporal scale as the generation of mass spectral data from the mass analyzer for a single mass spectrum (that is, completing a mass analysis for the analyte ions). The auxiliary ion detector may produce at least 3, 5, 10, 20, 25, 30, 50, 100, 200, 500 or 1000 ion currents in the same time period as the mass analyzer generates mass spectral data for a single mass spectrum.

In another sense, it can advantageously be considered that the auxiliary ion detector is configured to have an average frequency of ion current measurement which is higher than the average frequency of mass analysis of the mass analyzer. In other words, the auxiliary ion detector may produce ion current measurements more frequently on average than the mass analyzer provides mass spectral data (that is, completes a mass analysis).

In a yet further sense, it can be considered that the auxiliary ion detector is configured to determine the plurality of ion current measurements with a time interval therebetween (which may be an average, mean, median, mode, maximum or minimum value). Then, the mass analyzer may be configured to perform mass analysis of the second ion sample over a time duration that is longer than the time interval between the plurality of ion current measurements. In this sense, it may be understood that the auxiliary ion detector may produce ion current measurements more quickly than the mass analyzer provides mass spectral data (that is, completes a mass analysis).

Optionally, the mass spectrometer further comprises a mass filter, arranged upstream from the auxiliary ion detector (and preferably, downstream from the mass analyzer). The mass filter is advantageously configured to receive ions generated by the ion source and to transmit ions having a reduced range of mass-to-charge ratios. The reduced range is narrower than the initial range. Then, the first and second ion samples may be derived from the ions transmitted by the mass filter.

Preferably the mass spectrometer further comprises: a collision cell, located downstream from the ion source (and optionally, the mass filter). In this case, the mass spectrometer may be a tandem mass spectrometer. Beneficially, the collision cell is arranged to generate fragment ions from at least some of the ions generated by the ion source. The collision cell may be upstream or downstream from the mass analyzer and therefore may be in the main ion path from the ion source to the mass analyzer, in a branch ion path between the ion source and the mass analyzer or in a path downstream from the mass analyzer, for example in a "dead-end" configuration.

In some embodiments, the mass spectrometer further comprises: ion optics, located downstream from the ion source (and optionally, the mass filter). Advantageously, the ion optics are located upstream from the mass analyzer. The ion optics may be configured to control the path of received ions selectively, such that the received ions are directed towards the auxiliary ion detector in a first mode. This may be implemented in a number of different ways. Optionally, the ion optics are configured such that the received ions enter the ion optics in a first direction and, in the first mode, are directed to the auxiliary ion detector in a second direction, the second direction being different from the first direction. Preferably, the second direction is orthogonal to the first direction. In this case, the auxiliary ion detector may comprise: a conversion dynode; and a secondary electron multiplier (or another type of ion detector). The conversion dynode may be located on a first side of the ion optics along the second direction. Then, the secondary electron multiplier (or other type of ion detector) may be located on a second side of the ion optics, opposite the first side. Advantageously, the secondary electron multiplier (or other type of ion detector) may be configured to receive secondary electrons from the conversion dynode.

In the preferred embodiment, the ion optics comprises a quadrupole ion guide. The quadrupole ion guide preferably comprises four rod electrodes, an outer diameter of each of the four rod electrodes being smaller than any of the gaps between the four rod electrodes.

In embodiments, the ion optics are further configured to control the path of the received ions selectively, such that the received ions are directed towards an ion optical device other than the auxiliary ion detector in a second mode. In some embodiments, the ion optical device other than the auxiliary ion detector is a collision cell. In other embodiments, the ion optical device other than the auxiliary ion detector is the mass analyzer. In any case, the ion optics are preferably configured such that the received ions enter the ion optics in a first direction and, in the second mode, are directed in the first direction.

In some embodiments, the ions received at the ion optics are the ions generated by the ion source (that is, without any fragmentation, although mass selection may have been performed). In other embodiments, the mass spectrometer further comprises: a collision cell, located downstream from the ion source (and optionally, the mass filter) and upstream from the ion optics and arranged to generate fragment ions from at least some of the ions generated by the ion source. Then, the ions received at the ion optics may be the fragment ions generated in the collision cell.

Embodiments may be provided without the use of such ion optics. For example, the auxiliary ion detector may be located downstream from the mass analyzer. Then, the mass analyzer may be configured to operate selectively in a first mode, in which it is configured for mass analysis of received ions or in a second mode, in which it is configured to direct received ions to the auxiliary ion detector. For example, this may be possible if the mass analyzer is of time-of-flight type.

Optionally, the mass spectrometer further comprises: an ion storage device, located upstream from the mass analyzer. The ion storage device may be configured to receive ions for analysis by the mass analyzer, to store the received ions and to eject at least some of the stored ions to the mass analyzer. Preferably, the ion storage device is arranged to receive ions in an input direction and to eject ions in an output direction, different from the input direction. More preferably, the output direction is orthogonal to the input direction. Most preferably, the ion storage device is a curved trap. This is especially advantageous when the mass analyzer is of orbital trapping type.

Preferably, the mass analyzer is a high resolution mass analyzer. A high resolution mass analyzer may have greater than 50000, 70000 or 100000 Resolving Power, RP, at mass 400, for instance and an ultra-high resolution mass analyzer may have greater than 150000, 200000 or 240000 RP at mass 400, for example. An accurate mass analyzer may be understood as having less than 3 ppm accuracy with external calibration, for example. Optionally, the mass analyzer comprises one of: a time-of-flight type; an orbital trapping type; and a Fourier Transform Ion Cyclotron Resonance, FT-ICR, type.

In the preferred embodiment, the output stage is configured to provide the abundance measurement associated with at least some of the ions generated by the ion source, by adjusting the mass spectral data generated by the mass analyzer on the basis of the ion current measurement determined by the auxiliary ion detector.

The output stage is advantageously configured to combine the auxiliary ion detector output and the mass spectral data to establish one or more improved abundance measurements regarding the detected ions. Optionally, the first and second ion samples are both samples of the same set of ions. Then (but possibly also in other cases), the auxiliary ion detector may be configured to determine one or more total ion current measurements for the set of ions and preferably a plurality of total ion current measurements for the set of ions. In this way, the output stage may be configured to establish a plurality of abundance measurements for the set of ions, each abundance measurement being associated with a portion of the mass spectral data, for example for a range of mass-to-charge ratios that is a subset of the total range covered by the mass spectral data. Advantageously, the output stage may be configured, for each of the plurality of total ion current measurements, to establish a plurality of abundance measurements for the set of ions, each abundance measurement being associated with a portion of the mass spectral data. Preferably, each abundance measurement is established by adjusting the respective portion of the mass spectral data based on at least one of the total ion current measurements (and preferably the plurality of total ion current measurements). The output stage is preferably implemented by digital logic, a processor or computer.

This process may be taken further. In some embodiments, the mass analyzer is arranged to generate a plurality of sets of mass spectral data over a measurement time period. Then, the auxiliary ion detector may be configured to determine a plurality of ion current measurements, for each set of mass spectral data that is generated. The output stage is consequently beneficially configured thereby to establish a plurality of abundance measurements, each abundance measurements relating to a respective set of mass spectral data.

The plurality of ion current measurements and the mass spectral data may relate to ions generated over the same time period. Additionally or alternatively, the output stage may then be configured to use the plurality of ion current measurements to deconvolute the mass spectral data over the time period.

In some embodiments, at least one of the plurality or sequence of first ion samples (or the first ion sample, where there is only one) has the same range of mass-to-charge ratios as the second ion sample. In other embodiments, all of the first ion samples may be different in composition from the second ion sample.

In an advantageous embodiment, the ion source is configured to receive a plurality of samples over time. The plurality of samples may be generated using a chromatographic apparatus. For instance, these samples may be provided from an upstream chromatography system, such as a GC, HPLC or UHPLC system. For each received sample, the ion source may be configured to generate respective ions at respective times.

Embodiments may have a particular application in elemental analysis and especially in Inductively Coupled Plasma Mass Spectrometry (ICP-MS). The mass spectrometer may therefore be an elemental mass spectrometer. The ion source therefore preferably generates elemental ions. The mass spectrometer may therefore be an ICP mass spectrometer wherein the ion source may comprise an inductively coupled plasma torch. Such ion sources are capable of producing temperatures high enough to cause atomization and ionisation of the sample. Typically temperatures greater than 5000K are used in the ion source. The mass spectrometer and methods as described herein may thereby enable determination of elements, for example with atomic mass ranges 3 to 250.

In some embodiments, the output stage is configured to use the plurality of ion current measurements to deconvolute a mass chromatographic peak. Additionally or alternatively, the output stage may be configured to establish at least one abundance measurement (and preferably a plurality of abundance measurements) for each of the plurality of samples over time. This may be result in deconvolution, for instance. When the output stage may be configured to provide a plurality of abundance measurements for each of the plurality of samples, each abundance measurement may be associated with a portion of the mass spectral data for the respective sample (for example, for a range of mass-to-charge ratios that is a subset of the total range covered by the mass spectral data).

In one such embodiment, a tandem mass spectrometer comprising the mass filter, collision (fragmentation) cell and the mass analyzer is provided. A secondary electron multiplier (SEM) may be installed downstream from the ion source (and optionally, the mass filter), arranged to detect ions within a range of m/z ratios (A) when they are not used for tandem mass analysis. The multiplier quantitates Total Ion Current (TIC) over this range A with much higher temporal resolution than the high-resolution mass analyzer, while the latter provides slow quantitation of each of resolved components within range A. Fitting of these data may make it possible to deconvolute a temporal dependence for each of the resolved components with higher fidelity than from each of the detectors separately.

The approach taken by the present invention differs from Automatic Gain Control (AGC), because it adjusts the abundance measurement from the mass spectral data using the ion current measurement and preferably measurements determined by the auxiliary ion detector, whereas AGC actually affects the nature of the ions processed by the mass analyzer. However, the mass analyzer may be further configured to adjust the abundance of ions in the second ion sample on the basis of the ion current determined for the first ion sample. In other words, AGC can additionally be implemented with the invention.

In some embodiments, the mass spectrometer further comprises: a mass filter; an ion storage device; and a controller. The controller may be configured to: control the mass filter to select ions of a first range of mass-to-charge ratios; control the auxiliary ion detector to determine an ion current for the ions of the first range of mass-to-charge ratios; control the ion storage device to accumulate ions of the first range of mass-to-charge ratios in the ion storage device; and to repeat selection, determining and accumulating until a threshold quantity of ions of the first range of mass-to-charge ratios are stored in the ion storage device. Then, the controller may be further configured to control the mass analyzer to mass analyse the ions stored in the ion storage device. In particular, this analysis may be performed when the ion storage device stores the threshold quantity of ions of the first range of mass-to-charge ratios.

Optionally, the controller is further configured to: control the mass filter to select ions of a second range of mass-to-charge ratios; control the auxiliary ion detector to determine an ion current for the ions of the second range of mass-to-charge ratios; control the ion storage device to accumulate ions of the second range of mass-to-charge ratios in the ion storage device; and repeat the selection, determining and accumulating until a threshold quantity of ions of the second range of mass-to-charge ratios are stored in the ion storage device. The controller may be configured to control the mass analyzer to mass analyse the ions stored in the ion storage device when the ion storage device stores the threshold quantity of ions of the first range of mass-to-charge ratios and the threshold quantity of ions of the second range of mass-to-charge ratios.

In some embodiments, the mass spectrometer further comprises: a collision cell, downstream from the ion source (and optionally, the mass filter); and a controller. The controller is preferably configured to: control the auxiliary ion detector to determine an ion current for a first portion of the ions generated by the ion source; control the mass analyzer to mass analyse the first portion of the ions generated by the ion source; and control the collision cell to fragment a second portion of the ions generated by the ion source so as to generate fragment ions and to control the mass analyzer to mass analyse the fragment ions.

In another aspect, the present invention may be found in a method of mass spectrometry, comprising: generating ions having an initial range of mass-to-charge ratios at an ion source; determining, for each of a plurality (sequence) of first ion samples, a respective ion current measurement at an auxiliary ion detector that is located downstream from the ion source, the first ion sample being derived from the ions generated by the ion source; performing mass analysis on a second ion sample, thereby generating mass spectral data, at a mass analyzer that is located downstream from the ion source, the second ion sample being derived from the ions generated by the ion source; and establishing an abundance measurement associated with at least some of the ions generated by the ion source based on a combination of the mass spectral data generated by the mass analyzer and the ion current measurements determined by the auxiliary ion detector.

In a yet further aspect, the present invention may be provided by a method of mass spectrometry, comprising: generating ions having an initial range of mass-to-charge ratios at an ion source; determining an ion current for a first ion sample at an auxiliary ion detector that is located downstream from the ion source, the first ion sample being derived from the ions generated by the ion source; performing mass analysis on a second ion sample, thereby generating mass spectral data, at a mass analyzer that is located downstream from the ion source, the second ion sample being derived from the ions generated by the ion source; and establishing an abundance measurement associated with at least some of the ions generated by the ion source based on a combination of the mass spectral data generated by the mass analyzer and the ion current determined by the auxiliary ion detector. As with the first and second mass spectrometer aspects, although the various additional features described below are noted with reference to the first method aspect described above, they may be equally applicable to this second method aspect.

The step of determining a plurality of ion currents is carried out over a time period. In the preferred embodiment, the step of performing a mass analysis may comprise generating (only) a single set of mass spectral data over the same time period. The step of establishing an abundance measurement may therefore comprise establishing the abundance measurement based on a combination of the mass spectral data and the plurality of ion currents determined generated in the same time period.

Optionally, the average frequency of ion current measurement is higher than the average frequency of mass analysis. Additionally or alternatively, the plurality of ion current measurements are determined with a time interval therebetween (which may be an average, mean, median, mode, maximum or minimum value) and the step of performing mass analysis may take place over a time duration that is longer than the time interval between the plurality of ion current measurements.

In embodiments, the method further comprises filtering ions generated by the ion source at a mass filter, thereby transmitting ions having a reduced range of mass-to-charge ratios, the reduced range being narrower than the initial range. Then, the first and second ion samples may be derived from the ions transmitted by the mass filter.

Optionally, the method may further comprise steps corresponding with any of the functional features noted with respect to the mass spectrometer of the first or second aspect. Some of these are explicitly noted and expanded upon below. For example, the method may further comprise fragmenting at least some of the ions generated by the ion source. Then, the step of determining one or more ion current measurements may comprise determining a respective ion current measurement for each of one or more first portions of the ions generated by the ion source. Additionally or alternatively, the step of performing mass analysis may comprise mass analysing a first portion of the ions generated by the ion source. Additionally or alternatively, the step of fragmenting may comprise fragmenting a second portion of the ions generated by the ion source so as to generate fragment ions. The non-fragmented (precursor) ions may therefore be considered first portions of the generated ions and the fragment ions may be derived from the second portion of the generated ions. Additionally or alternatively, the method may further comprise performing mass analysis on the fragment ions.

In some embodiments, the method further comprises selectively controlling the path of ions downstream from the ion source (and optionally, the mass filter), such that the ions are directed towards the auxiliary ion detector in a first mode. The step of directing ions towards the auxiliary ion detector optionally comprises changing the direction of the ions, for example by causing an orthogonal change in direction. The method may further comprise selectively controlling the path of ions downstream from the ion source (and optionally, the mass filter), such that the ions are directed towards another ion optical device, such as a collision cell or a mass analyzer, in a second mode. Then, the step of directing ions towards another ion optical device in the second mode may comprise controlling the path of the ions without changing their direction.

In some embodiments, the method further comprises: storing ions for analysis by the mass analyzer in an ion storage device that is located upstream from the mass analyzer; and ejecting at least some of the stored ions to the mass analyzer. Then, the step of filtering ions may comprise selecting ions of a first range of mass-to-charge ratios at the mass filter. The step of determining an ion current may comprise determining an ion current for the ions of the first range of mass-to-charge ratios. The step of storing ions may comprise accumulating ions of the first range of mass-to-charge ratios in the ion storage device. The method may further comprise repeating the steps of selecting, determining and accumulating until a threshold quantity of ions of the first range of mass-to-charge ratios are stored in the ion storage device. The step of performing mass analysis may comprise mass analysing the ions stored in the ion storage device.

Optionally, the method further comprises: selecting ions of a second range of mass-to-charge ratios at the mass filter; determining an ion current for the ions of the second range of mass-to-charge ratios at the auxiliary ion detector; accumulating ions of the second range of mass-to-charge ratios in the ion storage device (optionally together with the stored ions of the first range of mass-to-charge ratios); and repeating the steps of selecting, determining and accumulating in respect of the ions of the second range of mass-to-charge ratios, until a threshold quantity of ions of the second range of mass-to-charge ratios are stored in the ion storage device. The step of performing mass analysis may comprise mass analysing the ions stored in the ion storage device when the ion storage device stores the threshold quantity of ions of the first range of mass-to-charge ratios and the threshold quantity of ions of the second range of mass-to-charge ratios.

Preferably, the step of establishing the abundance measurement comprises adjusting the mass spectral data generated by the mass analyzer on the basis of the ion current determined by the auxiliary ion detector.

In some embodiments, the first and second ion samples are both samples of the same set of ions. Then (although optionally in other cases), the step of determining an ion current may comprise determining one or more total ion current measurements (and preferably a plurality of ion current measurements) for the set of ions, such that the step of establishing the abundance measurement comprises, for each of the one or more total ion current measurements, establishing a plurality of abundance measurements for the set of ions, each abundance measurement being associated with a portion of the mass spectral data. For instance, each abundance measurement may be established by adjusting the respective portion of the mass spectral data based on at least one of the total ion current measurements.

The step of performing mass analysis may comprise generating a plurality of sets of mass spectral data over a measurement time period. Then, the step of determining a plurality of ion current measurements may comprise determining a plurality of ion current measurements for each set of mass spectral data that is generated. As a result, the step of establishing an abundance measurement may comprise establishing a plurality of abundance measurements, each abundance measurements relating to a respective set of mass spectral data.

The plurality of ion current measurements and the mass spectral data advantageously relate to ions generated over the same time period. Then, the step of establishing an abundance measurement may comprise using the plurality of ion current measurements to deconvolute the mass spectral data over the time period.

In embodiments, the step of generating ions at the ion source may comprise: receiving a plurality of samples over time; and for each received sample, generating respective ions. Optionally, the method further comprises generating the plurality of samples using chromatography. In either case, the step of establishing an abundance measurement may comprise establishing at least one abundance measurement for each of the plurality of samples. Preferably, the step of establishing at least one abundance measurement comprises establishing a plurality of abundance measurements for each of the plurality of samples, each abundance measurement being associated with a portion of the mass spectral data for the respective sample.

Another possible advantage of one or more of the techniques described herein is that the ion current measurements may be deconvoluted or resolved using the mass spectral data, which thereby can result in a more accurate abundance measurement from the auxiliary detector. The ion current measurements can be resolved using the mass spectral data to remove contributions from interferences. In particular, the data obtained using the spectrometer or methods as herein described can be used to resolve interferences within a mass range or mass ranges of interest (for example, as selected by a mass filter). This has applications, for example, in elemental analysis, such as in ICP-MS.

In preferred embodiments, the measured ion current obtained from the auxiliary ion detector is adjusted according to the share of the current due to an element of interest determined from the mass spectral data obtained from the mass analyzer. The high-resolution mass spectral data can resolve ions of elements of interest and ions of interferences. In particular, if the mass spectral data from the mass analyzer measures that a given fraction of the ion current comes from interferences (for instance, molecular interferences) rather than the element of interest, then the element of interest represents the remainder of the ion current (that is, the measured ion current minus the fraction due to interferences). The abundance measurement of the element of interest can therefore be corrected in this way to provide a more accurate quantitation. In contrast, the use of a conventional ICP-MS mass analyzer alone, such as a quadrupole device, would give a measurement that is inaccurate.

In another application, such use of the mass spectral data can be used to trigger adding a reaction gas to a reaction cell (upstream of the auxiliary detector and mass analyzer) to react with the molecular interferences, particularly if it is established from the mass spectral data that molecular interferences exceed a given fraction of the total ion current, for instance 20% or more, 30% or more, 40% or more, or 50% or more. Conventional reaction cells in single-quadrupole instruments can result in a significant attenuation of ion current (for instance between 3 and 10 fold) due to the need to attenuate interferences by many orders of magnitude. The use of a high-resolution mass analyzer in one or more of the techniques disclosed herein may reduce this requirement.

Additionally or alternatively, it may remove the need for a reaction cell or it may provide reliable attenuation control in the reaction cell, for instance allowing control of quantities such as the gas density and rate of reaction and, consequently, the ion losses. Thus, the mass spectral data may be used to control the addition of reaction gas to a reaction cell, especially for removing molecular interferences from the ion current measurement.

In still another aspect, the present invention may be found in a mass spectrometer, comprising: an ion source, arranged to generate ions having an initial range of mass-to-charge ratios; an auxiliary ion detector, located downstream from the ion source and arranged to receive a plurality of first ion samples derived from the ions generated by the ion source and to determine a respective ion current measurement for each of the plurality of first ion samples; a mass analyzer, located downstream from the ion source and arranged to receive a second ion sample derived from the ions generated by the ion source and to generate mass spectral data by mass analysis of the second ion sample, wherein the mass spectral data is used to control the addition of reaction gas to a reaction cell upstream of the auxiliary detector to remove molecular interferences from the ion current measurement; and an output stage, configured to establish an abundance measurement associated with at least some of the ions generated by the ion source based on the ion current measurements determined by the auxiliary ion detector.

The method may further comprise adjusting the abundance of ions in the second ion sample on the basis of at least one the ion current measurements determined for the first ion sample or samples. AGC may thereby be implemented in addition.

BRIEF DESCRIPTION OF THE DRAWINGS

The invention may be put into practice in various ways, a number of which will now be described by way of example only and with reference to the accompanying drawings in which.

DETAILED DESCRIPTION OF PREFERRED EMBODIMENTS

Figure 1:
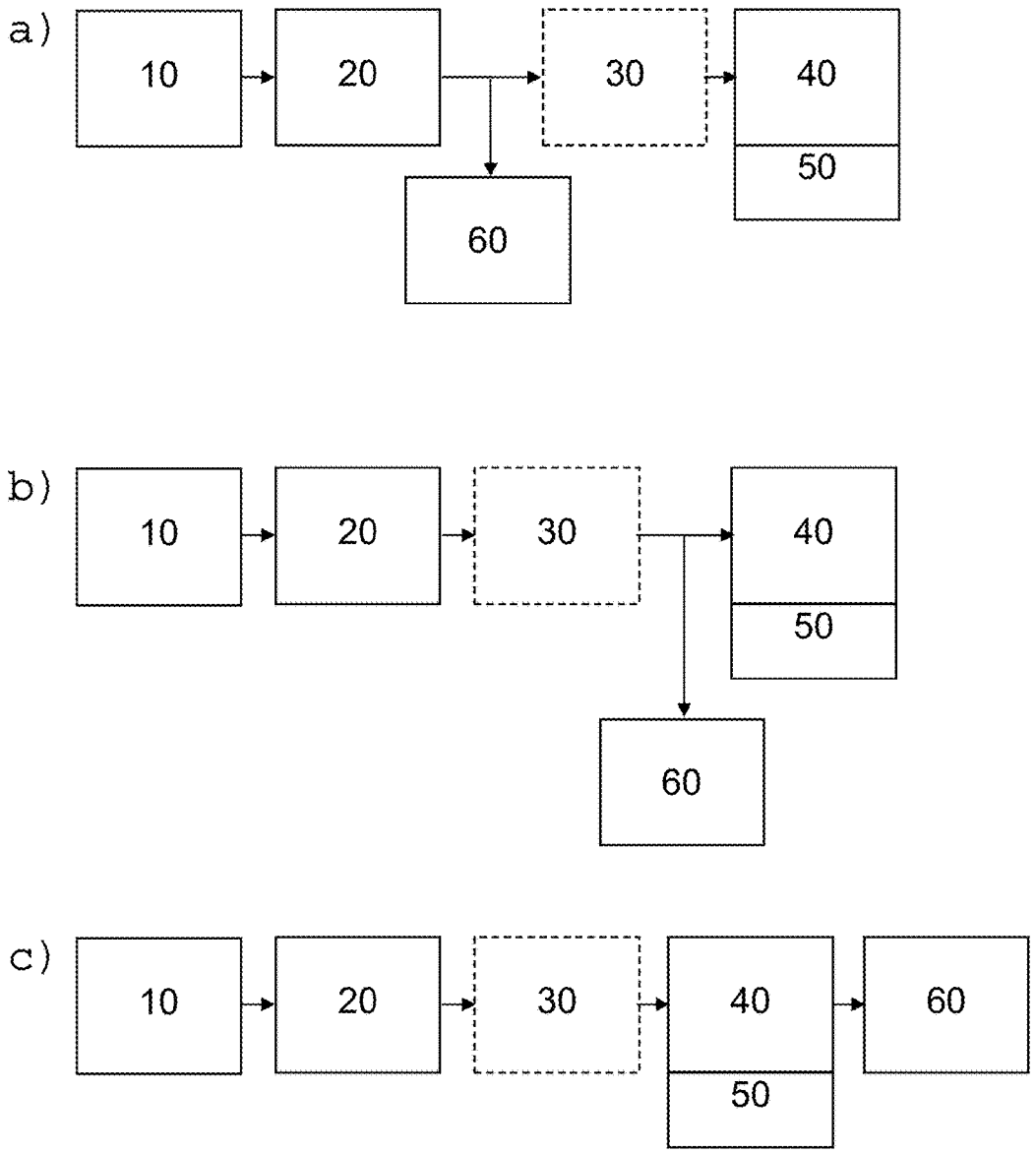
FIG. 1 shows schematic diagrams, illustrating different arrangements of components in order to implement respective embodiments of a mass spectrometer in accordance with the present invention.

Referring first to FIG. 1, there are shown schematic diagrams, illustrating different arrangements of components in order to implement respective embodiments of a mass spectrometer. Three embodiments are shown and each embodiment comprises: an ion source 10; a mass filter 20; an optional collision cell 30; a mass analyzer 40; a data acquisition system 50; and an auxiliary ion detector 60. The auxiliary ion detector 60 is typically a Secondary Electron Multiplier (SEM). The data acquisition system 50 may be understood as the output stage of the invention.

In each embodiment, ions are introduced from the ion source 10 through the mass filter 20. At least some of the ions are fragmented by the collision cell 30 and the fragments are analysed in a high-resolution mass analyzer 40 with data acquisition system 50. The additional auxiliary ion detector 60 is located on a side path downstream from the mass filter 20. The location of the auxiliary ion detector 60 varies between the different embodiments. The location of the auxiliary ion detector 60 may be one of the following.

a) At a location immediately downstream from the mass filter 20, prior to the collision cell 30. This location allows direct measuring of the total ion current (TIC) of precursor ions. However, this TIC might be significantly different from the total ion current of fragments (if fragmentation is employed). Also, a sophisticated ion optical system may be required to rapidly switch ions from a straight trajectory to a side path leading to the auxiliary detector 60.

b) At a location between the collision cell 30 and the high resolution analyzer 40. This location allows direct measuring of the TIC of fragments (if fragmentation is employed) and this may match the output of the data acquisition system 50 better. However, like option a) above, it may also require a sophisticated ion optical system to allow deflection towards the auxiliary ion detector 60.

c) At a location downstream from the collision cell 30 and the high-resolution analyzer 40. This location allows direct measurement of the TIC for fragments without the need for an elaborate ion optical system to deflect ions to the auxiliary ion detector 60. Instead, ions could simply be allowed to pass through the entire system when they are not deflected to the analyzer 40.

Figure 2A:
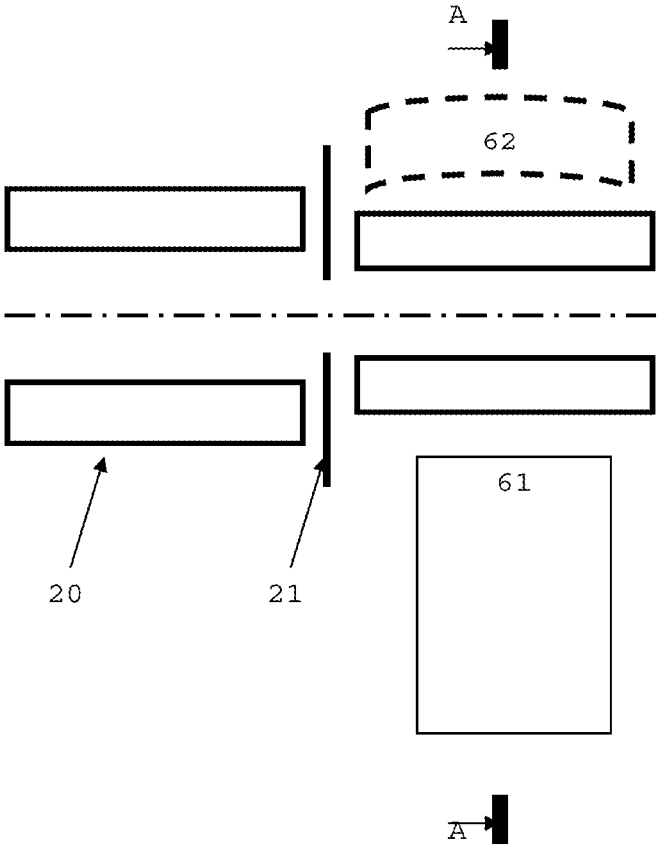
FIG. 2A schematically depicts a first view of deflection optics for use in the mass spectrometer of FIG. 1.
Figure 2B:
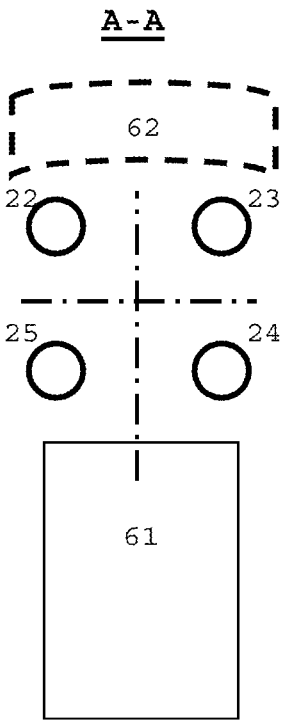
FIG. 2B schematically depicts a second view of the deflection optics of FIG. 2A.

As noted above, the first and second embodiments (marked a and b respectively) may require deflection optics for diverting ions towards the auxiliary ion detector 60. Referring next to FIG. 2, there is shown a schematic depiction of deflection optics for use in embodiments of the mass spectrometer shown in FIG. 1. A first view of the deflection optics is shown in FIG. 2A. A second view of the deflection optics of FIG. 2A is shown in FIG. 2B. This shows a cross-section through the line marked A-A. Where the same elements as shown in FIG. 1 are shown in FIG. 2, identical reference numerals have been used. The mass filter 20 has an exit aperture 21. The mass filter 20 is a quadrupole device with rods 22, 23, 24 and 25. The auxiliary ion detector comprises a SEM 61 and a conversion dynode 62.

As ions exit the quadrupole mass filter 20 through the aperture 21, they are transported by RF-only quadrupole ion guide rods 22-25 towards the collision cell 30 and/or mass analyzer 40 (not shown in this drawing). Preferably, the RF frequency of the potential applied to the rods 22-25 is between 2 and 5 MHz. Moreover, the rod outer diameter is preferably smaller than the gap between the rods.

For deflection towards the SEM 61, RF is rapidly switched off and rods 22 and 23 receive DC of the same polarity as the ion polarity (for example, +300V for positive ions). Rods 24 and 25 receive DC of the opposite polarity as ion polarity (for example, −300V for positive ions). This diverts ions to the SEM 61 which is biased at a high DC voltage of the opposite polarity than the ion polarity (for example, −2000V). Examples of appropriate switching electronics may be found in U.S. Pat. No. 7,498,571.

When molecular ions are to be detected, it is preferable to use post-acceleration. For example, this may be achieved by deflecting ions in the direction opposite to that of the SEM 61 (this is the upwards direction in FIG. 2) to the conversion dynode 62. Then, the DC field can be utilised for transporting resulting secondary ions or electrons towards the SEM 61 as known in the art.

Figure 3:
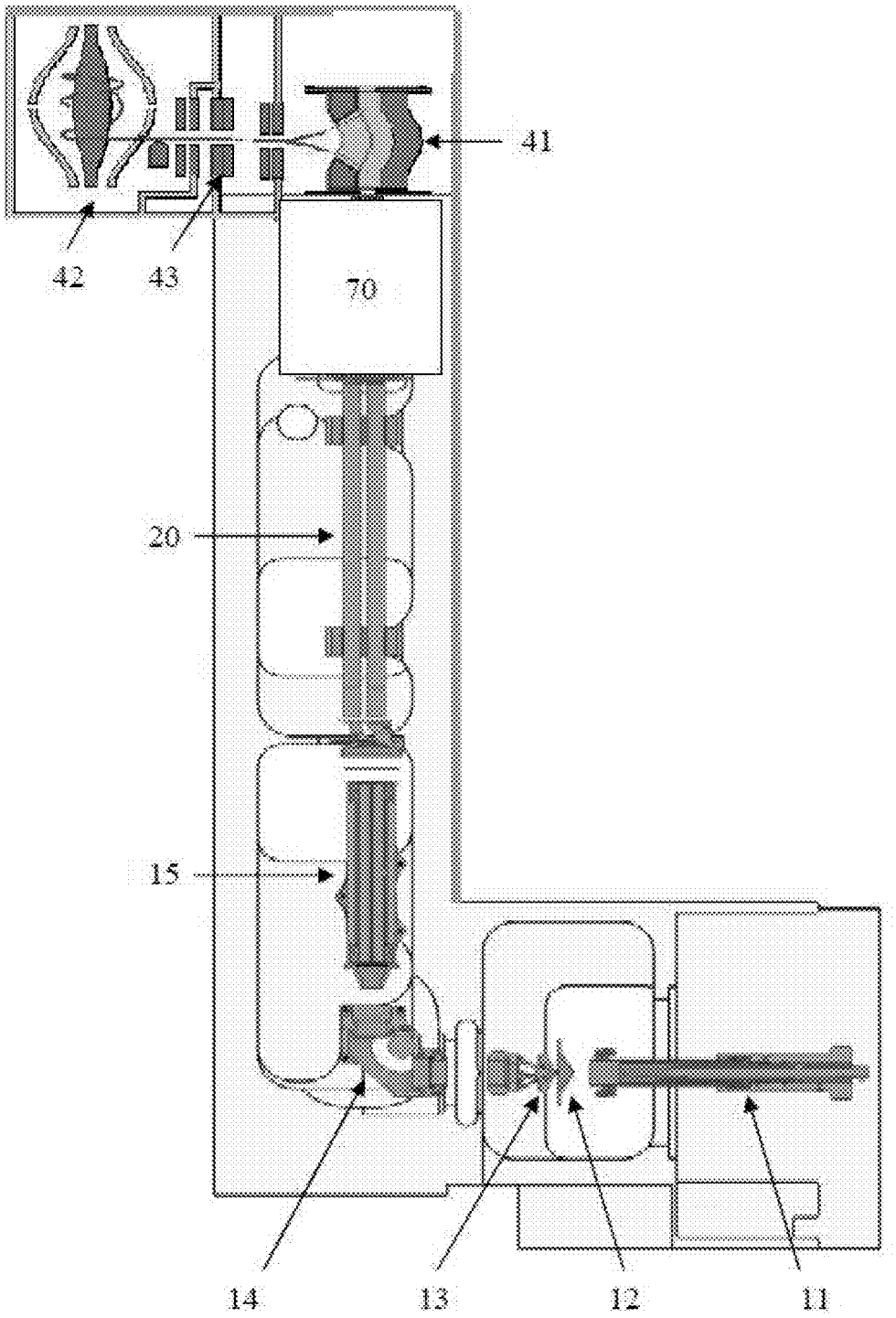
FIG. 3 illustrates a schematic diagram of a first mass spectrometer implementation in accordance with a first embodiment shown in FIG. 1.

Referring next to FIG. 3, there is illustrated a schematic diagram of a first mass spectrometer implementation in accordance with the first embodiment shown in FIG. 1. The embodiment shown in FIG. 1*a*) may be especially suitable for a situation when no collision cell 30 is required. For example, this may be the case in an instrument combining an Inductively-Coupled Plasma (ICP) source with a quadrupole mass filter 20 and a mass analyzer that is based on orbital trapping or TOF technology. Such an embodiment is shown in FIG. 3.

This implementation comprises: ICP torch 11; cone 12; skimmer 13; ion optics 14; collision cell 15; curved trap (C-trap) 41; orbital trapping mass analyzer 42; and ion optics 43. Control ion optics 70 are also provided downstream from the mass filter 20.

The mass filter 20 is a quadrupole device that isolates ions in a narrow range of mass-to-charge ratios. These are transmitted through the control ion optics 70 to the C-trap 41. Intermittently (for example, every 20 ms), these ions are deflected to the auxiliary ion detector (not shown) by the control ion optics 70, for accurate quantitation. The auxiliary ion detector may be located within the control ion optics 70, for instance in accordance with the design shown in FIG. 2. Any other means of selecting ions could be used alternatively or in addition, for example a drift tube, differential ion mobility filter, time-of-flight filter, magnetic sector or ion trap of any type.

The C-trap 41 accumulates ions over a prolonged period of time. This can therefore be used to store ions from multiple windows of mass-to-charge ratios (as selected by mass filter 20). These ions are ejected from the C-trap 41 through the ion optics 43 into the orbital trapping analyzer 42 for analysis. The analysis cycle of the orbital trapping analyzer 42 is relatively long in comparison with other periods, for instance, 100-300 ms. Thus, the ions are accumulated in a C-trap 41 until the orbital trapping analyzer 42 is ready for detection in each cycle.

Data obtained using this approach can be used to resolve interferences within the mass range or mass ranges of interest. The measured ion current is adjusted according to the share of element of interest obtained by means of the high-resolution mass spectrum. For example, if the TIC over a mass range of 10 amu is measured to be $10^9 \pm 1\%$ ions/second, whilst the orbital trapping mass analyzer measures that 20%±1% of this TIC comes from molecular interferences, then elements of interest represent 80%±1% and their correct intensity is $8\times10^8 \pm 1.4\%$. In other words, the use of a quadrupole mass analyzer alone would have given a measurement that is 20% inaccurate, though misleadingly precise. The presence of the high-resolution mass analyzer allows an improvement in accuracy, although there may be a slight deterioration of precision as a result.

Another example may be explained as follows. If it is established that molecular interferences dominate at, for instance, 50% or more, this may become a trigger for adding a reaction gas to the optical reaction cell 15 to react with the molecular interferences. The reaction gas may be helium, hydrogen or their mixture. Conventional reaction cells in single-quadrupole instruments result in a significant loss of ion current (between 3 and 10 fold). This is due to the need to attenuate interferences by many orders of magnitude. The presence of a high-resolution mass analyzer reduces this requirement. It may then be sufficient to provide the analyte signal with the same order of magnitude of intensity as any interferences combined. It may also provide reliable attenuation control, thus allowing reduction in the rate of reaction, gas density and consequently, ion losses.

The embodiments shown in FIGS. 1*a*) and 1*b*) are most appropriate for use with high-resolution mass analyzers of orbital trapping, FT-ICR and electrostatic trap type, because they require prolonged storage times. Moreover, the embodiment shown in FIG. 1*c*) is non-trivial to implement using these type of mass analyzers. However, the careful reduction of trapping potentials during fly-through may allow these mass analyzers to be used with the third embodiment as well.

Figure 4:
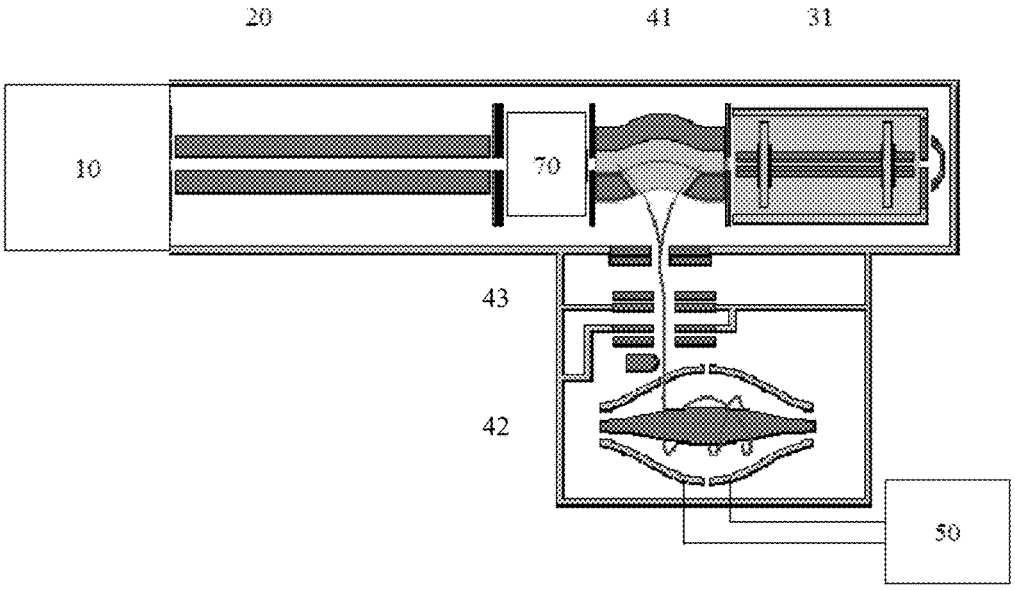
FIG. 4 illustrates a schematic diagram of a second mass spectrometer implementation based on the embodiments shown in FIG. 1.

Referring next to FIG. 4, there is shown a schematic diagram of a second mass spectrometer implementation based on the embodiments shown in FIG. 1. However, unlike the embodiments shown in FIG. 1, the position of the optional collision cell is altered, as will be explained below. Where the same elements are shown as in previous drawings, identical reference numerals have been used. The only component shown in FIG. 4 that is not shown in the previous drawings is the collision cell 31.

Ions generated in the ion source 10 are passed to the mass filter 20 and an auxiliary ion detector (not shown), as part of the control ion optics 70, is used to provide TIC measurements. Some ions transmitted by the mass filter 20 pass straight through the C-trap 41 into the dead-end reaction cell or collision cell 31. This can act as a storage device, but it can also act as a fragmentation cell in some circumstances. Ions stored in the C-trap 41 can selectively be ejected through the ion optics 43 to the orbital trapping mass analyzer 42. The data acquisition system 50 is coupled to the orbital trapping mass analyzer 42 to obtain detection image current output.

This design is a preferred embodiment for a tandem orbital trapping-based mass spectrometer, interfaced to fast separations, such as GC, HPLC or UHPLC. The auxiliary ion detector can be used to provide intermediate points on a chromatogram.

Figure 5:
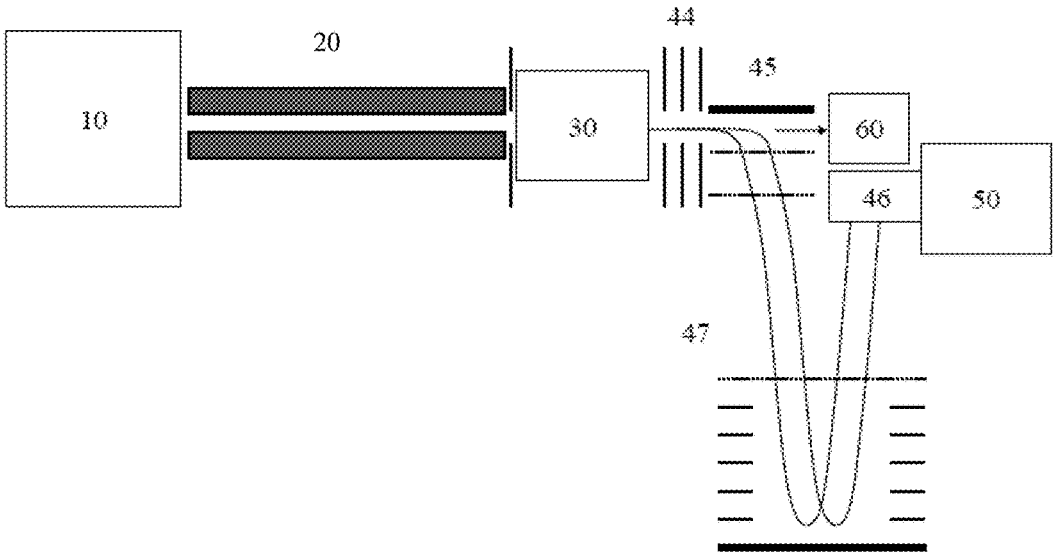
FIG. 5 illustrates a schematic diagram of a mass spectrometer implementation in accordance with a third embodiment shown in FIG. 1.

Referring next to FIG. 5, there is illustrated a schematic diagram of a mass spectrometer implementation in accordance with a third embodiment shown in FIG. 1. As before, where the same elements are shown as used in previous drawings, identical reference numerals have been employed. This embodiment is preferred for tandem mass spectrometry based on orthogonal acceleration TOF (oaTOF) mass analyzeranalyzers. Also provided are: lens optics 44; an orthogonal accelerator 45; a detector 46; and at least one ion mirror 47.

The high-resolution oaTOF is interfaced to the collision cell 30 by the lens optics 44. Although an oaTOF mass analyzer is capable of pulsing ion packets with a repetition rate of up to 10-30 kHz, for instance, its low transmission (such as 0.2% to a few percent) requires prolonged addition of spectra in order to acquire sufficient statistics. Typically, such mass analyzers pulse out only a portion of the ion beam, equivalent to several microseconds of flow and the orthogonal accelerator 45 is then refilled with ions until the entire analyzer is free of previously injected ions. This could take up to hundreds of microseconds. Therefore, ions are free to pass through the orthogonal accelerator 45 and to be detected by the detector 60 (preferably with post-acceleration, as described above) until the next pulse. Using this approach, the detector 60 may be used to detect up to 50 to 70% of all ions arriving at the mass analyzer. In other words, it may require five to ten times less time to reach the same statistical precision compared with detector 46.

The design of this third embodiment could be implemented with the instrument of FIG. 4, for example if the detector is located behind the collision cell at the end of the ion path.

Figures 6, 7:
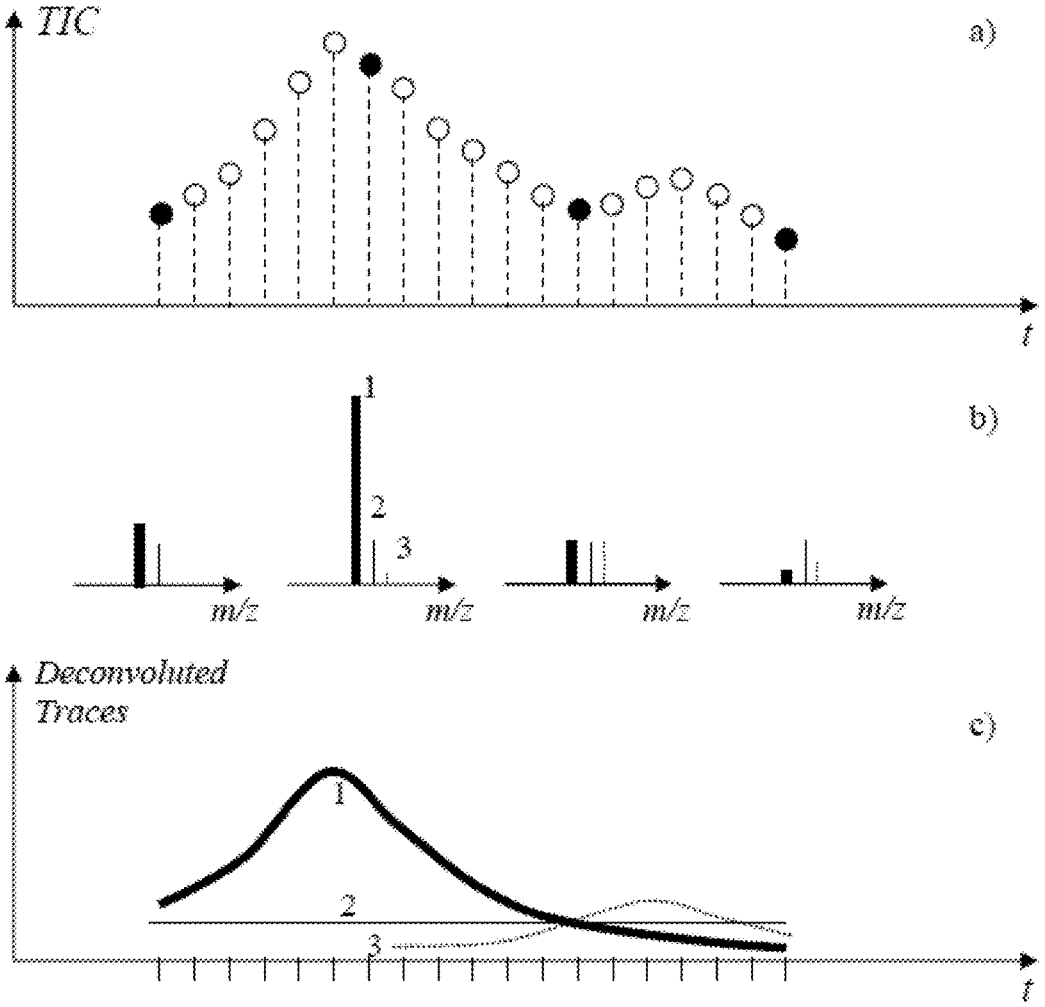
FIG. 6 shows example results from a mass spectrometer in accordance with the present invention illustrating the deconvolution of data.
FIG. 7 shows a table of the specified relative amounts of the elements and interfering components in a mixture of a simulated example.

Referring now to FIG. 6, there are shown example output results from a mass spectrometer in accordance with the present invention used to sample a chromatographic peak. This is used to illustrate the deconvolution of data. The process of deconvolution uses inputs from both the auxiliary ion detector and the mass analyzer. In this example, the high-resolution detector of the mass analyzer is six times slower than the auxiliary ion detector (for example, a SEM). In other words, the auxiliary ion detector samples the peak six times faster. As a result, the high-resolution detector of the mass analyzer under-samples the chromatographic peak. Nevertheless, utilising the measurements from the auxiliary ion detector, deconvolution allows restoration of the peak shape and makes it more suitable for quantitation.

The output of the auxiliary ion detector (showing total ion current) is plotted against time in FIG. 6*a*). For each of the points marked with a black dot, in FIG. 6*a*), a mass spectrum (the output of the mass analyzer) is shown in FIG. 6*b*). Up to three peaks (labelled 1, 2 and 3) are marked in each mass spectrum. The first peak 1 is marked with a thick solid line, the second peak 2 is marked with a thin solid line and the third peak 3 is marked with a thin dotted line. The deconvoluted traces showing the ion currents for first peak 1, second peak 2 and third peak 3 are then shown in FIG. 6*c*), allowing for better definition of the peak form and area under the peak. The latter may be directly linked to the amount of sample injected. If only the peak intensities from the mass spectrum in FIG. 6*b* were used, it would lead to different peak shapes and less accurate quantitation.

The quality of deconvolution may be dependent on the quality of chromatographic peak model, reproducibility of the peak shapes and signal-to-noise (S/N) ratios of the underlined peaks. It is anticipated that the majority of practical cases permit integration of the chromatographic peaks. As a result, the accuracy of the quantitative analysis may be significantly improved in view of the introduction of the auxiliary ion detector. It is also anticipated that such deconvolution could be run in real time as peak elutes, thus allowing for data-dependent change of conditions, for example of temporal points of sampling ions by either the auxiliary ion detector or the mass analyzer.

A number of mathematical methods can be used to improve deconvolution. These may include: methods of multi-scale modelling; best-fitting methods with different norms (for instance, L2 or Huber norms) and scale space theory in signal processing (including pyramid representation and edge detection).

Referring now to FIGS. 7 to 13, a simulated example will be described illustrating how the ion current measurements may be deconvoluted or resolved using the mass spectral data, thereby to result in a more accurate abundance measurement from the auxiliary detector for a particular ion species or element of interest. In particular, the example shows how the mass spectral data can be used to remove contributions to the ion current from interferences. If the auxiliary detector were used alone, or if only low resolution mass spectral data were available, the observed ion current measurement may not only represent the ion species of interest but also interfering ion species of the same or similar mass to the ion species of interest. Using one or more of the techniques described herein, the measured ion current obtained from the auxiliary ion detector is adjusted according to the share of the current due to an element of interest determined from the high resolution mass spectral data obtained from the mass analyzer.

The example described simulates the determination of calcium and other major elements in a stainless steel sample. The sample ions may be produced and analysed by an ICP-MS spectrometer, for example as shown in FIG. 3.

Figure 8:
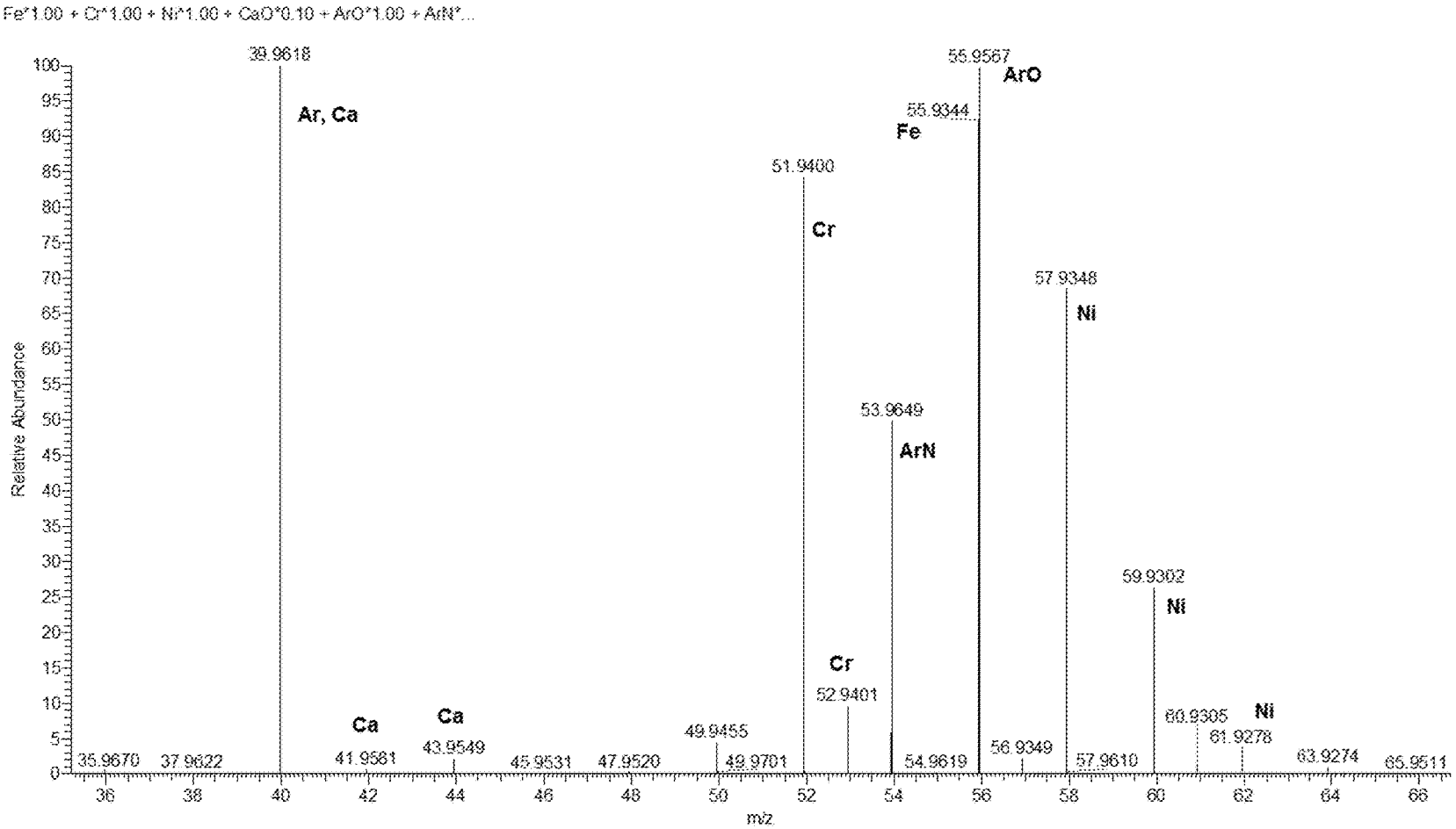
FIG. 8 depicts an overview spectrum showing the mixture of the simulated example as shown in FIG. 7 plus Ar in amount 1.

Referring to FIG. 7, there is shown a table of the specified relative amounts of the elements and interfering components in the mixture of the simulated example. The amounts indicated are only for the purpose of illustration of the invention, such that they do not represent typical peak intensities for the elements. The system is first studied at high resolution (500 k; such resolution is well within the possible range for an Orbital Trapping mass analyzer such as the Orbitrap™). An overview spectrum is depicted in FIG. 8. The spectrum shows the mixture as entered (see FIG. 7) plus Ar in amount 1.

Figure 9:
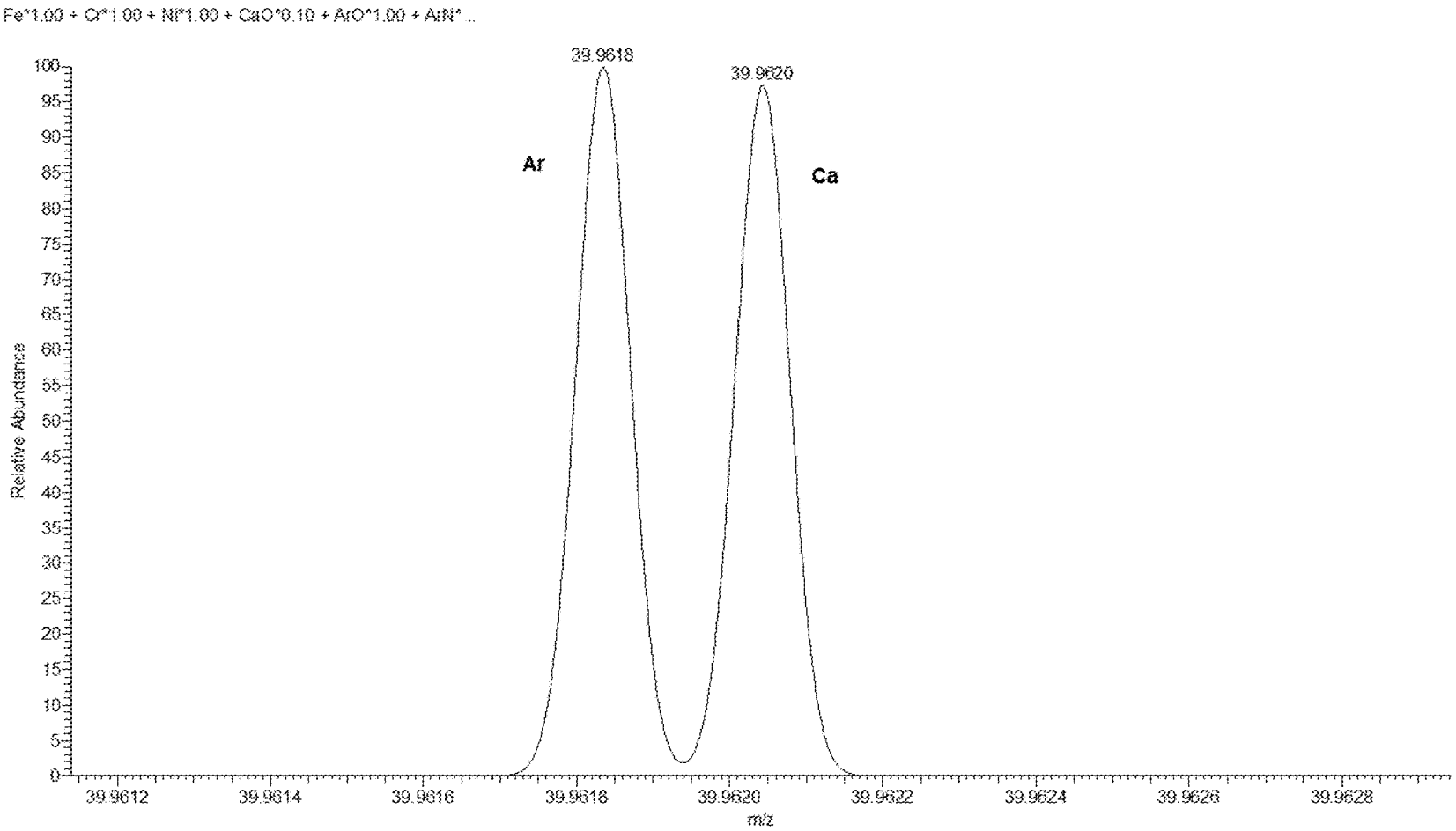
FIG. 9 shows a magnified portion of FIG. 8 around the m/z 40 region.
Figure 10:
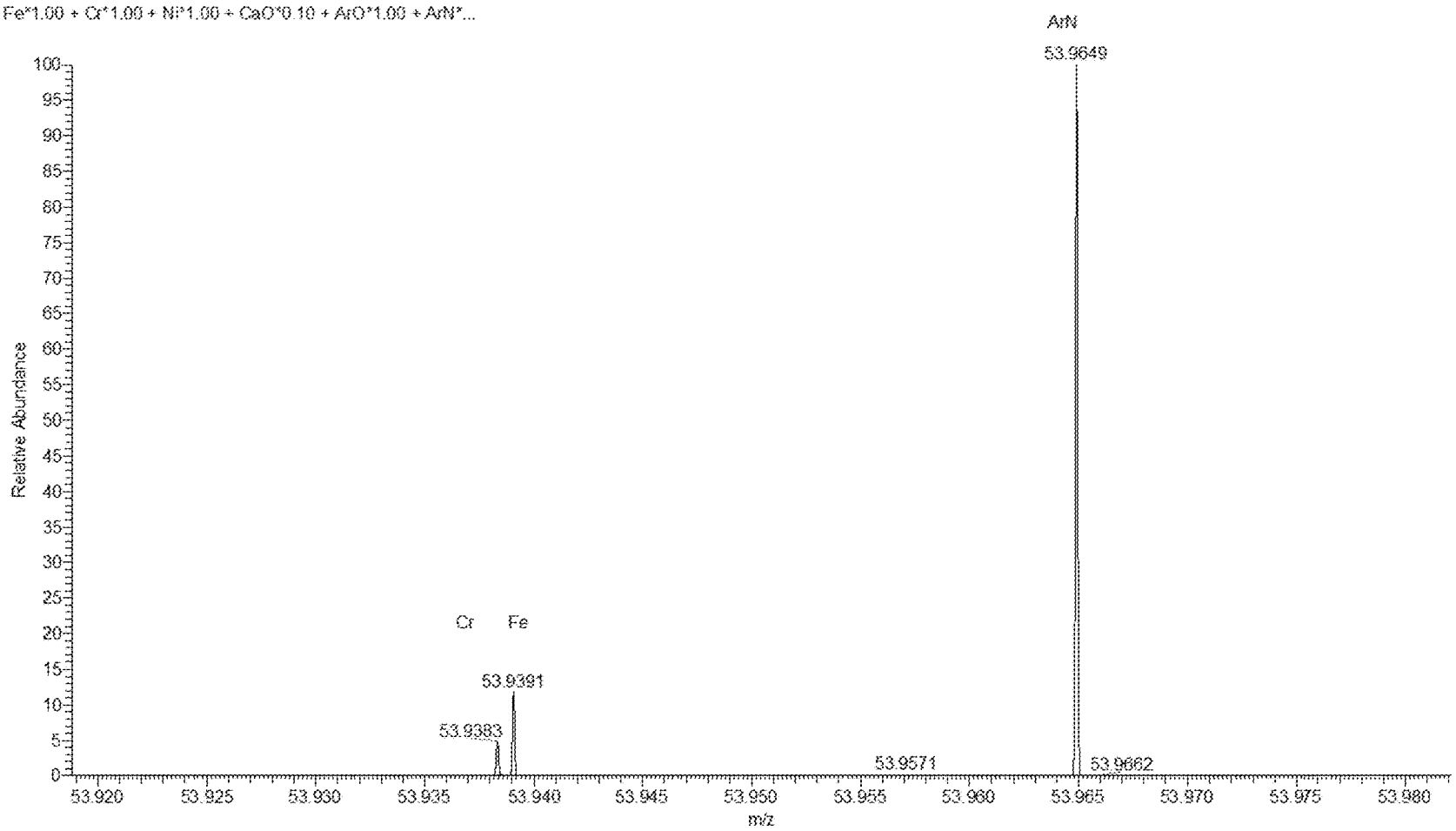
FIG. 10 shows a magnified portion of FIG. 8 around the m/z 54 region.
Figure 11:
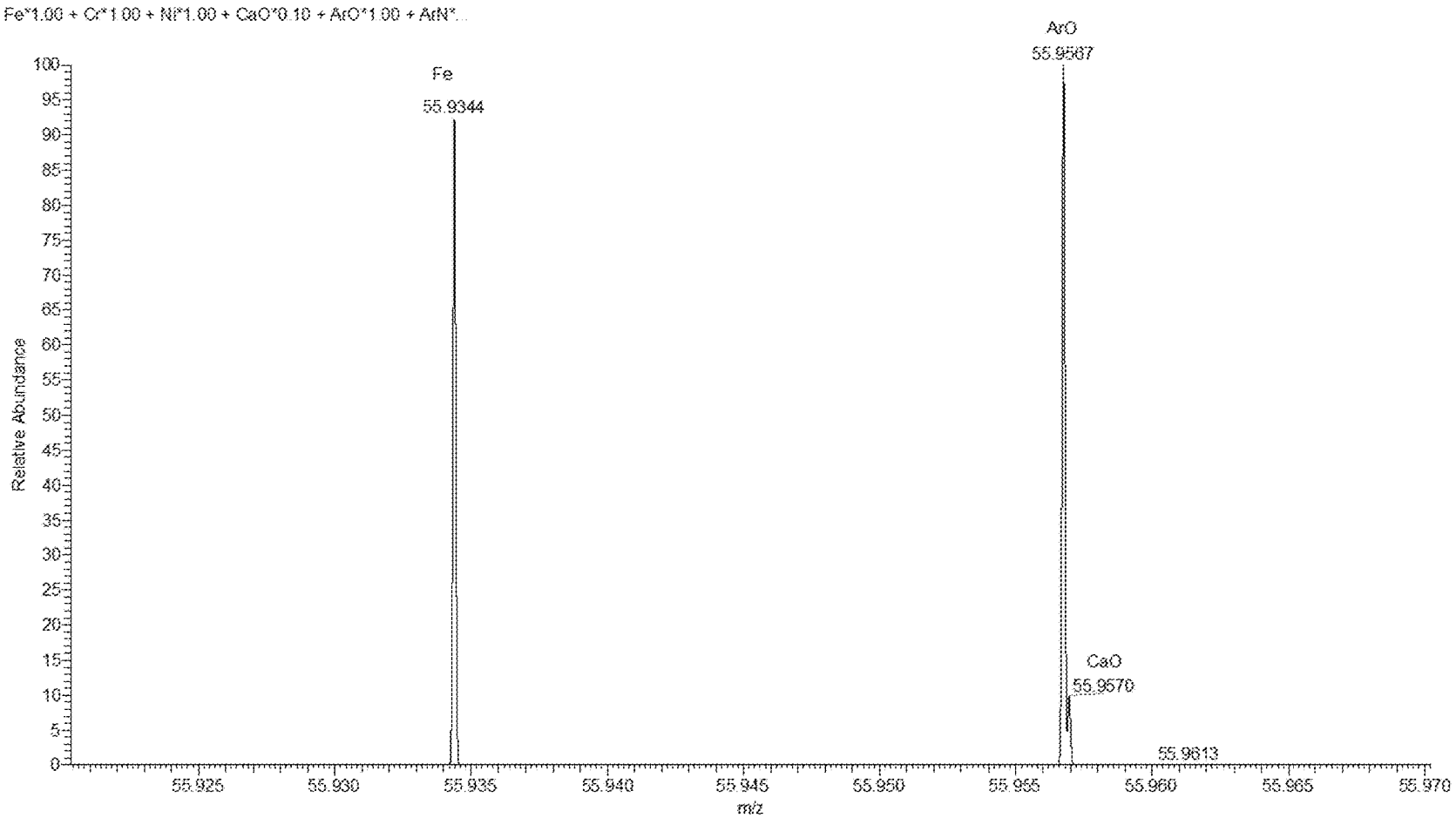
FIG. 11 shows a magnified portion of FIG. 8 around the m/z 56 region.
Figure 12:
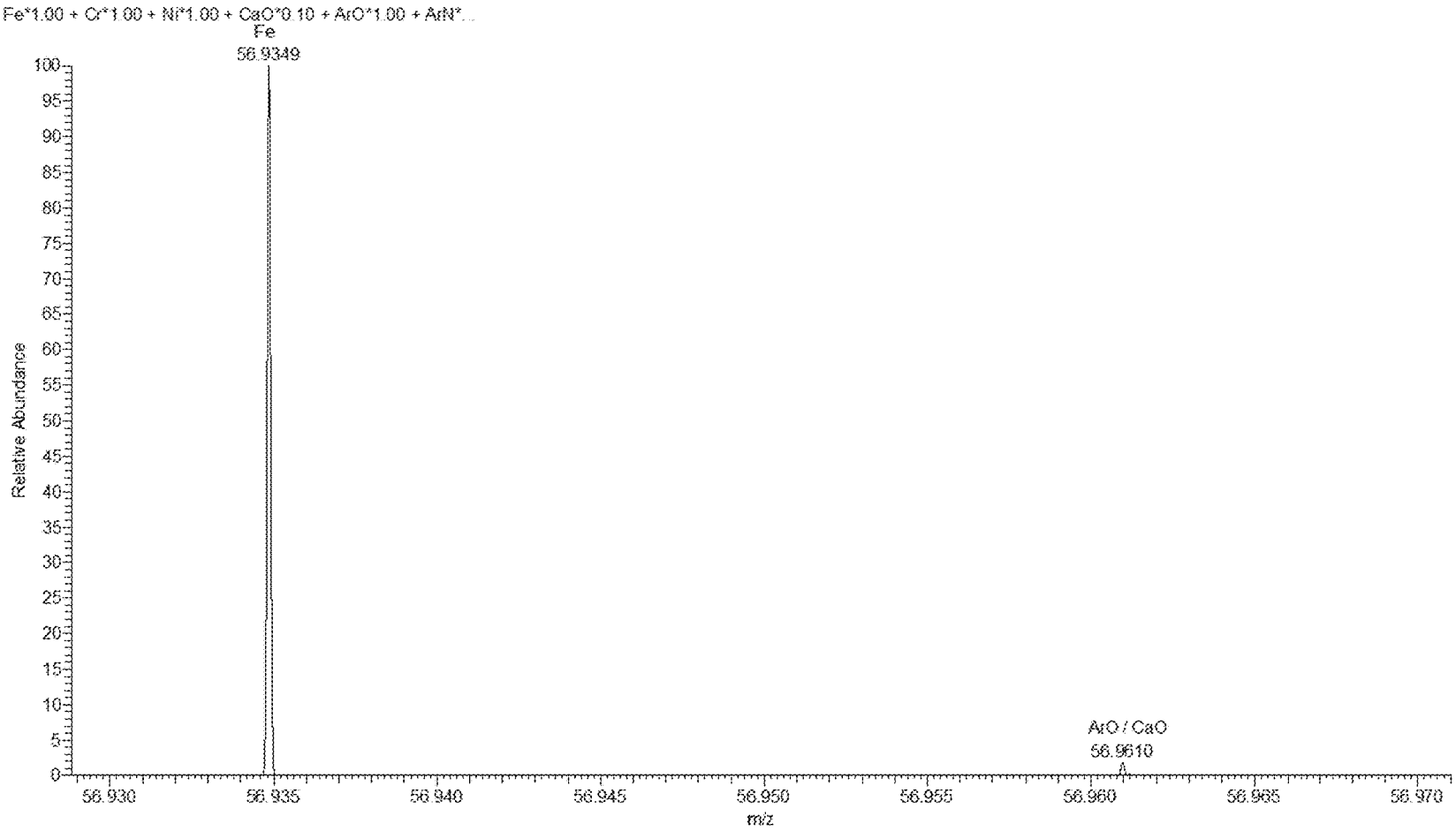
FIG. 12 shows a magnified portion of FIG. 8 around the m/z 57 region.
Figure 13:
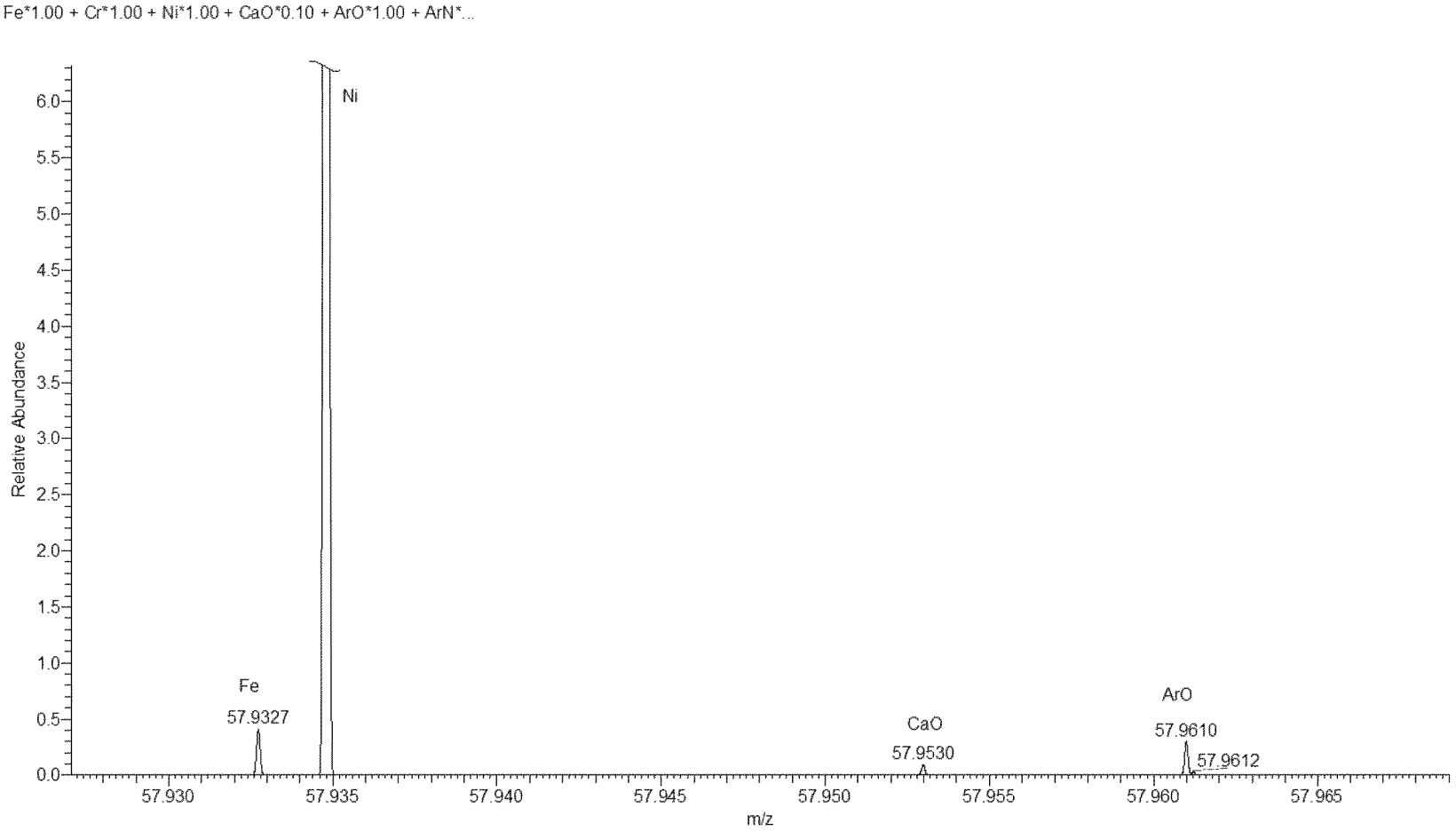
FIG. 13 shows a magnified portion of FIG. 8 around the m/z 58 region.

Zooming into the peaks one by one, it can be seen in FIG. 9, which zooms into the m/z 40 region, that there are two peaks not one and that the ratio Ar:Ca=1:1. However, the quantitation of Ca at mass 40 may be difficult even at 500 k resolution. In real measurements the Ar peak may be orders of magnitude higher than Ca, which means that, besides possible dynamic range issues, Ca may appear as just a small feature in the tail of the Ar peak. The peaks at m/z 42 and 44 (shown in FIG. 8) are undisturbed Ca peaks and this is where Ca should be observed and/or quantified, despite the low relative abundance (2%) of these peaks compared to $^{40}Ca$.

Other elemental peaks that can be resolved from interferences using one or more of the technique disclosed herein are shown with reference to FIGS. 8 and 10 to 13. At m/z 50, chromium ($^{50}Cr$) has a possible interference from $^{36}Ar^{14}N$. At m/z 52, chromium has a very minor interference from $^{34}Ar^{18}O$, which looks small in this case, but may become significant when trying to determine Cr at trace levels on this isotope. At m/z 53, chromium appears with even smaller interferences of ArN and ArO. At m/z 54, there are small peaks of Cr, Fe and $^{40}Ar^{14}N$ (see FIG. 10). At m/z 55 is $^{40}Ar^{15}N$. At m/z 56 is Fe (the main isotope) with interferences of ArO and CaO. As can be clearly seen, while resolving the two interferences from one another requires the full 500 k resolution, separation of both interferences from Fe will be possible at much lower resolution (see FIG. 11). At m/z 57 is Fe with interference of $^{40}Ar^{17}O$ (and $^{40}Ca^{17}O$; see FIG. 12) and at m/z 58 is Fe (interference) with Ni and interferences of CaO and ArO (see FIG. 13).

The spectra show that even a common "simple" element like iron in steel is difficult to measure interference-free, without the benefit of one or more of the techniques described herein.

Although specific embodiments have now been described, the skilled person will appreciate that variations and modifications are possible. For example, types of detectors could be used as an auxiliary ion detector other than an SEM, such as an avalanche diode, microchannel and microsphere plates, channeltrons, and similar types of detector. Types of external storage device other than a C-trap 41 could be used, as known in practice.

It should be noted that the auxiliary ion detector (such as SEM) could additionally be used for automatic gain control (AGC), as known in the art. Depending on the ion current, the fill time for the mass analyzer may be adjusted for subsequent accumulation upstream from an orbital trapping mass analyzer, or transmission at the lens optics 44 in the oaTOF embodiment. The combination of AGC and the analytical measurement of TIC in the same detection cycle may be especially advantageous, for example as explained in International Patent Publication No. WO-2012/160001 (having common ownership with the present invention).

Whilst some of the specific implementations described above have used a specific mass analyzer, it may be recognised that another type of mass analyzer can be substituted in some cases. Similarly, it will be understood that a part of the configuration in embodiment can be combined with another part of the configuration in another embodiment. For example, the ICP source and interface configuration of FIG. 3 might be employed with the dead-end collision cell of FIG. 4 or oaTOF mass analyzer of FIG. 5.

The interleaved operation of two detectors (the auxiliary ion detector and the detector of the mass analyzer) could be combined with multiplexed filling of the high-resolution mass analyzer, especially in the case of trapping analyzers. By switching the quadrupole mass filter between different mass windows, the auxiliary ion detector could acquire TIC information for each mass window until sufficient ion statistics are obtained. Typically, this may be up to 1000 or 10000 ion counts or equivalent. Then, ions could be directed to a downstream ion storage device, such as the C-trap 41 and/or dead-end collision cell 31 in the embodiments described above, for sufficient fill time and these could be accumulated with the already stored ions. Subsequently, the next mass window may be selected and the process repeated until the mass analyzer is ready to detect stored ions. Then, the summed (that is, multiplexed) ion population is injected into the mass analyzer and the next cycle starts. Each mass window in the spectrum generated by the mass analyzer can then be related to the corresponding TIC reading from the auxiliary ion detector which could be used for quantitation, removal of interferences or both.

A further possible application for such a mode of operation is in the targeted quantitation of peptides and proteins. In this case, the auxiliary ion detector can measure the TIC of precursor ions with high temporal resolution while the mass analyzer can determine the share of impurities or interferences (in a full MS scan). This can then confirm the presence of a precursor of interest by detection of multiple predicted fragments (in an MS/MS scan mode using fragmentation in a collision cell). Such an approach would allow a coefficient variation of a few percent even when the signal-to-noise ratio of fragments is less than 5 and chromatographic peak width is below 1 second.

Any number of further mass analysis or ion production and processing stages could be added to any item of the schematic diagram shown in FIG. 1. This also includes possible reversal or looping of the ion path, as known in the art.

I claim:

1. A mass spectrometer, comprising:

an ion source, arranged to generate ions having an initial range of mass-to-charge ratios;

an auxiliary ion detector, located downstream from the ion source and arranged to receive a plurality of first ion samples having a reduced range of mass-to-charge ratios that is narrower than the initial range derived from the ions generated by the ion source and to determine a respective ion current measurement for each of the plurality of first ion samples;

a mass analyzer, located downstream from the ion source and arranged to receive a second ion sample derived from the ions generated by the ion source and to generate mass spectral data by mass analysis of the second ion sample, wherein a resolution of the mass spectral data is high enough to mass resolve the ion current measurement determined by the auxiliary ion detector within the reduced range of mass-to-charge ratios; and a processor configured to:

control reaction conditions in a reaction cell upstream of the auxiliary detector based on the mass spectral data; and establish an abundance measurement associated with at least some of the ions generated by the ion source based on the ion current measurements determined by the auxiliary ion detector.

2. The mass spectrometer of claim 1, further comprising:

a mass filter, arranged upstream from the auxiliary ion detector and configured to receive ions generated by the ion source and to transmit ions having a reduced range of mass-to-charge ratios, the reduced range being narrower than the initial range; and wherein the first and second ion samples are derived from the ions transmitted by the mass filter.

3. A method of mass spectrometry, comprising:

generating ions having an initial range of mass-to-charge ratios at an ion source;

filtering ions generated by the ion source at a mass filter, thereby transmitting ions having a reduced range of mass-to-charge ratios, the reduced range being narrower than the initial range;

determining, for each of a plurality of first ion samples, a respective ion current measurement at an auxiliary ion detector that is located downstream from the ion source, the first ion samples being derived from the ions generated by the ion source and transmitted by the mass filter;

performing mass analysis on a second ion sample, thereby generating mass spectral data, at a mass analyzer that is located downstream from the ion source, the second ion sample being derived from the ions generated by the ion source and transmitted by the mass filter, wherein a resolution of the mass spectral data is high enough to mass resolve the ion current measurement determined by the auxiliary ion detector within the reduced range of mass-to-charge ratios; and establishing an abundance measurement associated with at least some of the ions generated by the ion source based on a combination of the mass spectral data generated by the mass analyzer and the ion current measurements determined by the auxiliary ion detector.

4. The method of claim 3, wherein the step of determining a plurality of ion currents is carried out over a time period and wherein the step of performing a mass analysis comprises generating a single set of mass spectral data over the time period.

5. The method of claim 3, wherein the average frequency of ion current measurement is higher than the average frequency of mass analysis.

6. The method of claim 5, wherein the plurality of ion current measurements are determined with a time interval therebetween and wherein the step of performing mass analysis takes place over a time duration that is longer than the time interval between the plurality of ion current measurements.

7. The method of claim 3, further comprising:

fragmenting at least some of the ions generated by the ion source.

8. The method of claim 7, wherein:

the step of determining a plurality of ion current measurements comprises determining a respective ion current measurement for each of a plurality of first portions of the ions generated by the ion source;

the step of performing mass analysis comprising mass analyzing a first portion of the ions generated by the ion source;

the step of fragmenting comprises fragmenting a second portion of the ions generated by the ion source so as to generate fragment ions; and the method further comprises performing mass analysis on the fragment ions.

9. The method of claim 3, further comprising:

selectively controlling the path of ions downstream from the ion source, such that the ions are directed towards the auxiliary ion detector in a first mode.

10. The method of claim 9, wherein the step of directing ions towards the auxiliary ion detector comprises changing the direction of the ions.

11. The method of claim 10, wherein changing the direction of the ions comprises causing an orthogonal change in direction.

12. The method of claim 9, further comprising:

selectively controlling the path of ions downstream from the ion source, such that the ions are directed towards a collision cell or a mass analyzer in a second mode.

13. The method of claim 12, wherein the step of directing ions towards a collision cell or a mass analyzer in the second mode comprises controlling the path of the ions without changing their direction.

14. The method of claim 3, further comprising:

storing ions for analysis by the mass analyzer in an ion storage device that is located upstream from the mass analyzer; and ejecting at least some of the stored ions to the mass analyzer.

15. The method of claim 14, wherein:

the step of filtering ions comprises selecting ions of a first range of mass-to-charge ratios at the mass filter;

the step of determining an ion current comprises determining an ion current for the ions of the first range of mass-to-charge ratios;

the step of storing ions comprises accumulating ions of the first range of mass-to-charge ratios in the ion storage device;

the method further comprises repeating the steps of selecting, determining and accumulating until a threshold quantity of ions of the first range of mass-to-charge ratios are stored in the ion storage device; and the step of performing mass analysis comprises mass analyzing the ions stored in the ion storage device.

16. The method of claim 15, further comprising:

selecting ions of a second range of mass-to-charge ratios at the mass filter;

determining an ion current for the ions of the second range of mass-to-charge ratios at the auxiliary ion detector;

accumulating ions of the second range of mass-to-charge ratios in the ion storage device; and repeating the steps of selecting, determining and accumulating in respect of the ions of the second range of mass-to-charge ratios, until a threshold quantity of ions of the second range of mass-to-charge ratios are stored in the ion storage device; and wherein the step of performing mass analysis comprises mass analyzing the ions stored in the ion storage device when the ion storage device stores the threshold quantity of ions of the first range of mass-to-charge ratios and the threshold quantity of ions of the second range of mass-to-charge ratios.

17. The method of claim 3, wherein the step of establishing the abundance measurement comprises adjusting the mass spectral data generated by the mass analyzer on the basis of the ion current determined by the auxiliary ion detector.

18. The method of claim 3, wherein the first and second ion samples are both samples of the same set of ions and the step of determining a plurality of ion current measurements comprises determining a total ion current for the set of ions, such that the step of establishing the abundance measurement comprises, for each of the plurality of total ion current measurements, establishing a plurality of abundance measurements for the set of ions, each abundance measurement being associated with a portion of the mass spectral data.

19. The method of claim 18, wherein each abundance measurement is established by adjusting the respective portion of the mass spectral data based on at least one of the total ion current measurements.

20. The method of claim 3, wherein the step of performing mass analysis comprises generating a plurality of sets of mass spectral data over a measurement time period and wherein the step of determining a plurality of ion current measurements comprises determining a plurality of ion current measurements for each set of mass spectral data that is generated, the step of establishing an abundance measurement comprising establishing a plurality of abundance measurements, each abundance measurements relating to a respective set of mass spectral data.

21. The method of claim 3, wherein the plurality of ion current measurements and the mass spectral data relate to ions generated over the same time period and wherein the step of establishing an abundance measurement comprises using the plurality of ion current measurements to deconvolute the mass spectral data over the time period.

22. The method of claim 3, wherein the step of generating ions at the ion source comprises:

receiving a plurality of samples over time; and for each received sample, generating respective ions; and wherein the step of establishing an abundance measurement comprises establishing at least one abundance measurement for each of the plurality of samples.

23. The method of claim 22, wherein the step of establishing at least one abundance measurement comprises establishing a plurality of abundance measurements for each of the plurality of samples, each abundance measurement being associated with a portion of the mass spectral data for the respective sample.

24. The method of claim 22, further comprising:

generating the plurality of samples using chromatography.

25. The method of claim 3, further comprising:

adjusting the abundance of ions in the second ion sample on the basis of the ion current determined for the first ion sample.

26. The method of claim 3, wherein the ion source generates elemental ions.

27. The method of claim 26, further comprising resolving the ion current measurements using the mass spectral data.

28. The method of claim 27, wherein the ion current measurements are resolved using the mass spectral data to remove contributions from interferences.

29. The method of claim 28, wherein the ion current measurements are adjusted according to the share of the current due to an element of interest determined from the mass spectral data.

* * * * *